US005154156A

United States Patent [19]

Ohuchi

[11] Patent Number: 5,154,156

[45] Date of Patent: Oct. 13, 1992

[54] FAILURE DIAGNOSIS DEVICE OF AN EXHAUST GAS RECIRCULATION CONTROL DEVICE

[75] Inventor: Hirofumi Ohuchi, Himeji, Japan

[73] Assignee: Mitsubishi Denki Kabushiki Kaisha, Tokyo, Japan

[21] Appl. No.: 778,297

[22] Filed: Oct. 16, 1991

[30] Foreign Application Priority Data

Nov. 7, 1990 [JP] Japan ..... 2-305053

[51] Int. Cl.[5] ..... F02M 25/07

[52] U.S. Cl. ..... 123/571

[58] Field of Search ..... 123/571; 364/431.06

[56] References Cited

U.S. PATENT DOCUMENTS

| | | | |
|---|---|---|---|
| 4,640,257 | 2/1987 | Kodama et al. | 123/571 |
| 4,671,107 | 6/1987 | Chiesa et al. | 123/571 |
| 4,715,348 | 12/1987 | Kobayashi et al. | 123/571 |
| 4,770,146 | 9/1988 | Shibata et al. | 123/571 |
| 4,825,841 | 5/1989 | Norota et al. | 123/571 |
| 4,938,198 | 7/1990 | Suzuki | 123/571 |
| 4,967,717 | 11/1990 | Miyazaki et al. | 123/571 |

FOREIGN PATENT DOCUMENTS

| | | | |
|---|---|---|---|
| 51746 | 3/1987 | Japan | 123/571 |
| 162761 | 7/1987 | Japan | 123/571 |
| 170747 | 7/1989 | Japan | 123/571 |
| 170748 | 7/1989 | Japan | 123/571 |

*Primary Examiner*—Willis R. Wolfe

*Attorney, Agent, or Firm*—Sughrue, Mion, Zinn, Macpeak and Seas

[57] ABSTRACT

A failure diagnosis device of an exhaust gas recirculation control device which comprises a recirculation pipe for recirculating the exhaust gas of the internal combustion engine to an intake air pipe; a recirculation valve for controlling a flow quantity of the exhaust gas flowing in the recirculation pipe; a recirculation valve passage area controlling means for controlling a passage area of the recirculation valve; a running condition detecting means for detecting a running condition of the internal combustion engine; a first detected value memorizing means for memorizing a first detected value which is detected by the running condition detecting means when the passage area of the recirculation valve is in a first state of being wide, by the recirculation valve passage area controlling means; a second detected value memorizing means for memorizing a second detected value which is detected by the running condition detecting means when the passage are of the recirculation valve is in a second state of being zero, by the recirculation valve passage area controlling means; a calculating and correcting means for calculating a difference value between the first detected value and the second detected value and for correcting the difference value based on on of the first and the second detected values; a determining means for determining whether the corrected value is in a predetermined range; and an alarming means for alarming when the determining means determines that the corrected value is out of the predetermined range.

2 Claims, 4 Drawing Sheets

FAILURE DIAGNOSIS DEVICE OF AN EXHAUST GAS RECIRCULATION CONTROL DEVICE

BACKGROUND OF THE INVENTION

1. Field of the Invention

This invention relates to a failure diagnosis device which diagnoses a failure in an exhaust gas recirculation control device.

2. Discussion of Background

Formally, an exhaust gas recirculation control device (hereinafter, EGR control device) which performs a control of exhaust gas recirculation (hereinafter, EGR) as a means of decreasing $NO_x$ in exhaust gas of an internal combustion engine, is widely used. This EGR control device performs the control of EGR by an exhaust pressure control system using BPT (Back Pressure Transducer) valve. A passage area of the EGR valve is controlled by a BPT valve so that an EGR flow quantity becomes a predetermined value. Furthermore, also in a system using VVT (Venturi Vacuum Transducer) and the system in which an EGR control pressure is controlled by a solenoid, similar to the system using the BPT valve, the passage area of the EGR valve is controlled.

As a means of diagnosing a failure in such EGR control device, conventionally, a device described in Japanese Unexamined Patent Publication No. 51746/1987, is proposed. In this device, an intake manifold pressure value wherein an EGR flow quantity exists, and an intake manifold pressure value wherein the EGR flow quantity does not exist, are detected. When the difference between the above pressures is out of a predetermined range, an alarming is generated.

In the conventional failure diagnosis device of an EGR control device, a failure state of the device can not be precisely diagnosed, when the EGR flow quantity is increased due to a deterioration of BPT or the like.

SUMMARY OF THE INVENTION

It is an object of the present invention to provide a failure diagnosis device of an exhaust gas recirculation control device capable of solving above problems.

According to an aspect of the present invention, there is provided a failure diagnosis device of an exhaust gas recirculation control device adapted to control to recirculate a part of exhaust gas of an internal combustion engine back to the internal combustion engine which comprises a recirculation pipe for recirculating the exhaust gas of the internal combustion engine to an intake air pipe; a recirculation valve for controlling a flow quantity of the exhaust gas flowing in the recirculation pipe; a recirculation valve passage area controlling means for controlling a passage area of the recirculation valve; a running condition detecting means for detecting a running condition of the internal combustion engine; a first detected value memorizing means for memorizing a first detected value which is detected by the running condition detecting means when the passage area of the recirculation valve is in a first state of being wide, by the recirculation valve passage area controlling means; a second detected value memorizing means for memorizing a second detected value which is detected by the running condition detecting means when the passage area of the recirculation valve is in a second state of being zero, by the recirculation valve passage area controlling means; a calculating and correcting means for calculating a difference value between the first detected value and the second detected value and for correcting the difference value based on one of the first and the second detected values; a determining means for determining whether the corrected value is in a predetermined range; and an alarming means for alarming when the determining means determines that the corrected value is out of the predetermined range.

According to another aspect of the present invention, there is provided a failure diagnosis device of an exhaust gas recirculation control device adapted to control to recirculate a part of exhaust gas of an internal combustion engine back to the internal combustion engine which comprises a recirculation pipe for recirculating the exhaust gas of the internal combustion engine to an intake air pipe; a recirculation valve for controlling a flow quantity of the exhaust gas flowing in the recirculating pipe; a recirculation valve passage area controlling means for controlling a passage area of the recirculation valve; a running condition detecting means for detecting a running condition of the internal combustion engine; a first detected value memorizing means for memorizing a first detected value which is detected by the running condition detecting means when the passage area of the recirculation valve is in a first state of being wide, by the recirculation passage area controlling means; a second detected value memorizing means for memorizing a second detected value which is detected by the running condition detecting means when the passage area of the recirculation valve is in a second state of being zero, by the recirculation valve passage area controlling means; a calculating and controlling means for calcualting a difference value between the first detected value and the second detected value and for correcting the difference value based on a measured value of a quantity of air sucked to the internal combustion engine or a value of a function of an engine revolution number and a throttle opening degree; a determining means for determining whether the corrected value is in a predetermined range; and an alarming means for alarming when the determining means determines that the corrected value is out of the predetermined range.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Explanation will be given to the present invention referring drawings.

Figure 1:
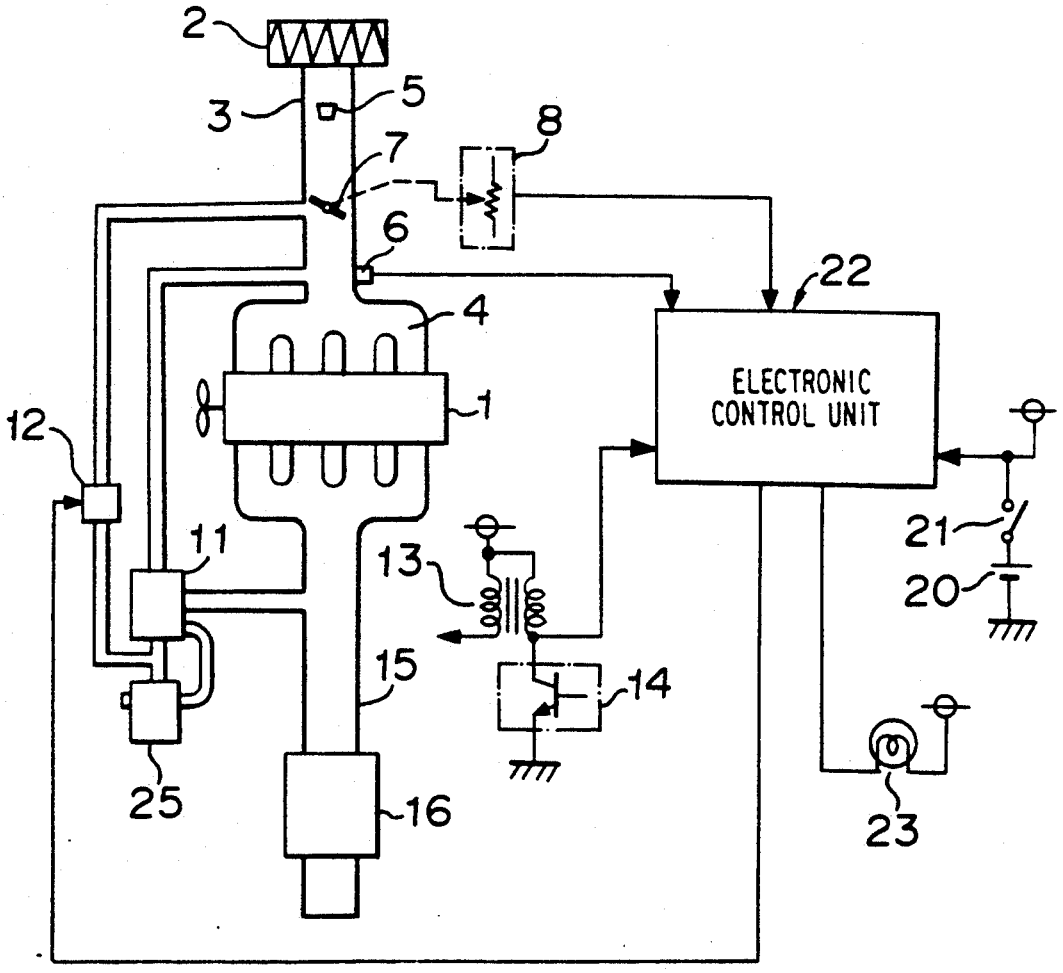
FIG. 1 is a block diagram showing an embodiment of a failure diagnosis device of an exhaust gas recirculation control device according to the present invention.

FIG. 1 is a block diagram showing an embodiment of the failure diagnosis device of an exhaust gas recirculation control device according to the present invention. In FIG. 1, a reference numeral 1 designates an engine, 3, an intake air pipe, 4, an intake manifold, 5, an injector, 6, a pressure sensor, 7, a throttle valve, 8, a throttle opening degree sensor, 11, a recirculation valve, 12, a passage area control actuator (hereinafter, EGR solenoid), 13, an ignition coil, 14, an igniter, 15, an exhaust pipe, 20, a battery, 21, an ignition key switch, 22, an electronic control unit, 23, an alarming lamp, and 25, a BPT valve.

In FIG. 1, the pressure sensor 6 is a semiconductor type pressure sensor which detects an intake air pressure for measuring a quantity of air sucked from the intake air pipe 3 to the engine 1 through the intake manifold 4. The injector 5 is located at upstream side of the throttle valve 7, and performs fuel injection. The throttle opening degree sensor 8 is attached to the throttle valve 7, for detecting an opening degree of the throttle valve. Furthermore, the ignition coil 13 performs ignition by a signal from the igniter 14, and sends a generated ignition signal to the electronic control unit 22.

Furthermore, the recirculation valve 11 is a vacuum servo type valve which is located at an exhaust gas recirculation passage which connects the intake air pipe 3 with the exhaust pipe 15. Furthermore, the EGR solenoid 12 is connected to the BPT valve 25, a diaphragm chamber of the recirculation valve 11, and the intake air pipe 3, and controls a negative pressure to the diaphragm chamber of the recirculation valve 11 by a signal of the electronic control unit 22. Furthermore, a passage area of the recirculation valve 11 becomes variable by the negative pressure of the diaphragm chamber.

Next, the electronic control unit 22 receives respective signals of the pressure sensor 6, the throttle opening degree sensor 8 and the ignition coil 13, and controls the passage area of the EGR recirculation valve 11. The electronic control unit 22 receives the respective signals and obtains a control quantity of the EGR solenoid 12 for controlling the EGR flow quantity, and controls to drive the EGR solenoid 12.

Figure 2:
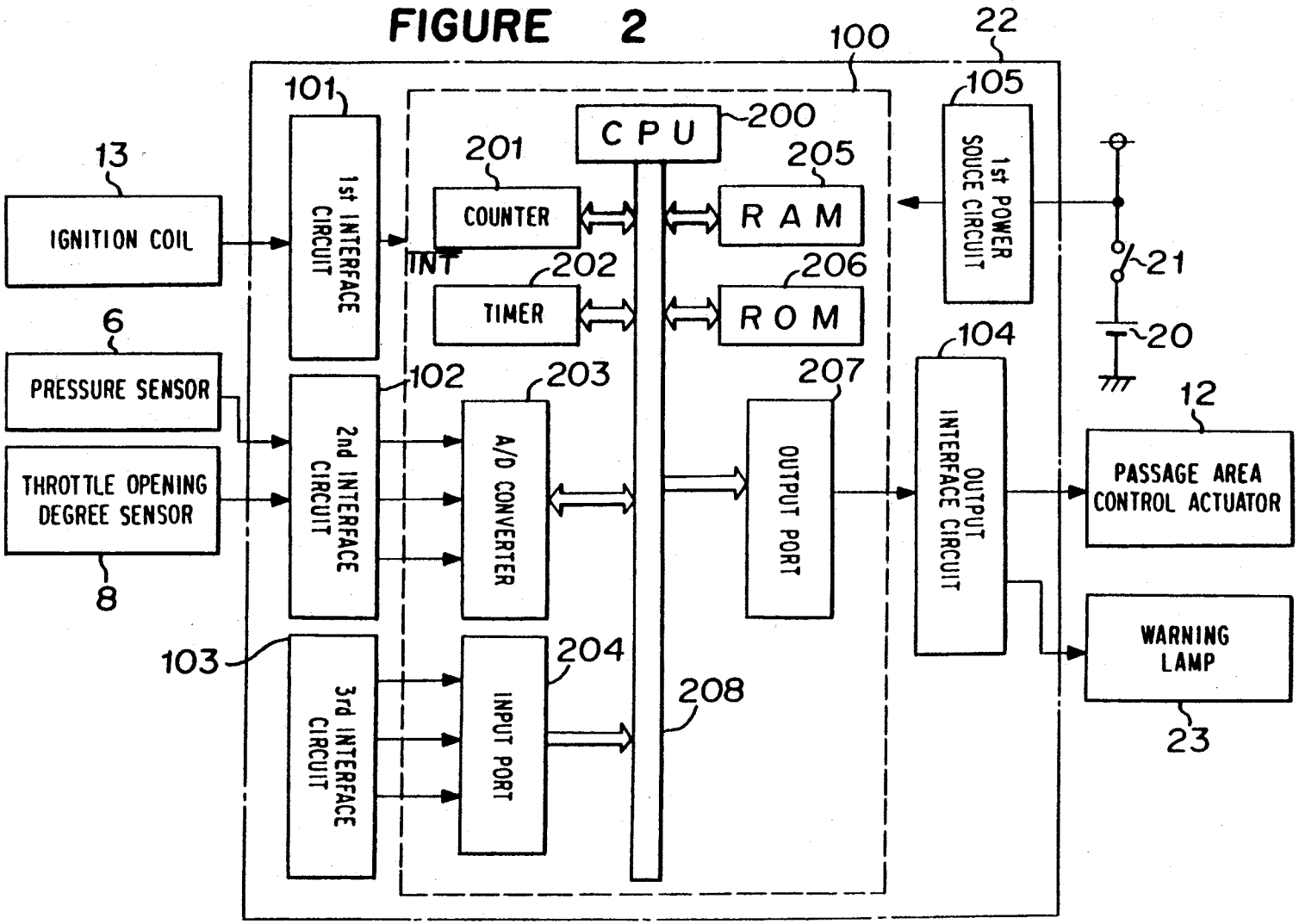
FIG. 2 is a block diagram of an electronic control unit which controls the failure diagnosis device.

FIG. 2 is a detailed block diagram of the electronic control unit 22. In FIG. 2, a reference numeral 100 designates a microcomputer, which is composed of the CPU 200 which calculates a control quantity of the EGR solenoid 12 or the like following a predetermined program, the free running counter 201 for measuring a rotation period of the engine 1, the timer 202 which measures by clock a duty ratio of a drive signal applied to the EGR solenoid 12, the A/D converter 203 which converts an analogue input signal to a digital signal, the RAM 205 which is used as a work memory, the ROM 206 in which programs are memorized, and the output port 207 for outputting the drive signal, and the common path 208 or the like. A numeral 101 designates a first input interface circuit, which shapes a primary side ignition signal of the ignition coil 13, and output it to the microcomputer 100 as an interruption signal. When this interruption signal is generated, the CPU 200 reads a value of the counter 201, and calculates a period of an engine revolution number from difference between the current read value and the preceding read value which is memorized in the RAM 205. A numeral 102 designates a second input interface circuit, which receives the respective signals of the pressure sensor 6, the throttle opening degree sensor 8 and the like, and outputs them to the A/D converter 203. A numeral 104 designates an output interface circuit, which amplifies the drive signal from the output port 207 and output it to the EGR solenoid.

Figure 3:
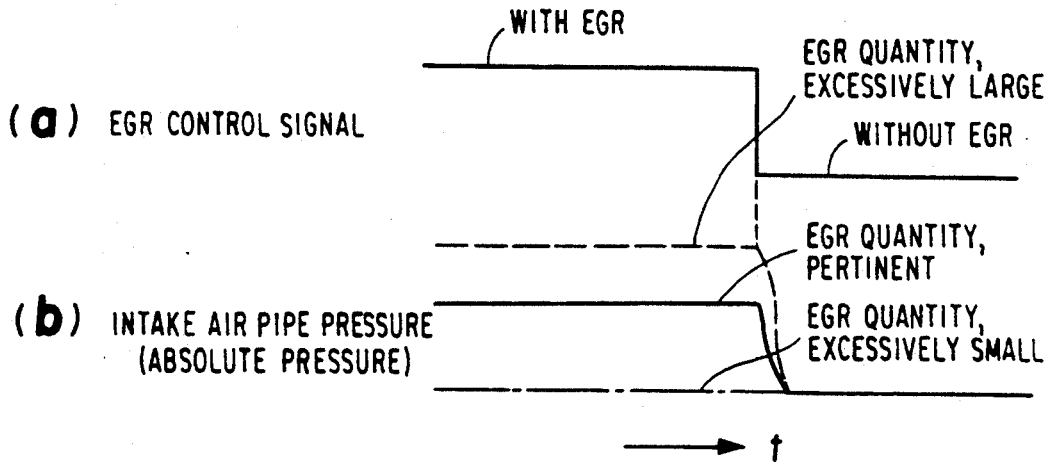
FIG. 3 is an explanatory diagram describing a characteristic of an intake air pipe corresponding with existence or nonexistence of the EGR flow quantity in this exhaust gas recirculation control device.

Next, FIG. 3 is an explanatory diagram showing a relationship between the EGR control signal and the intake air pipe pressure. Generally speaking, as shown in FIG. 3, when the EGR flow quantity is excessively large or pertinent, a pressure difference of the intake manifold 4, that is, the pressure difference between a pressure value in case that the EGR solenoid 12 is operated and the EGR flow quantity exists, and a pressure value in case that the EGR solenoid 12 is not operated and accordingly the EGR flow quantity does not exist, becomes a predetermined value or more. However, when the EGR flow quantity is excessively small, the pressure difference of the intake manifold 4 becomes small.

Figure 4:
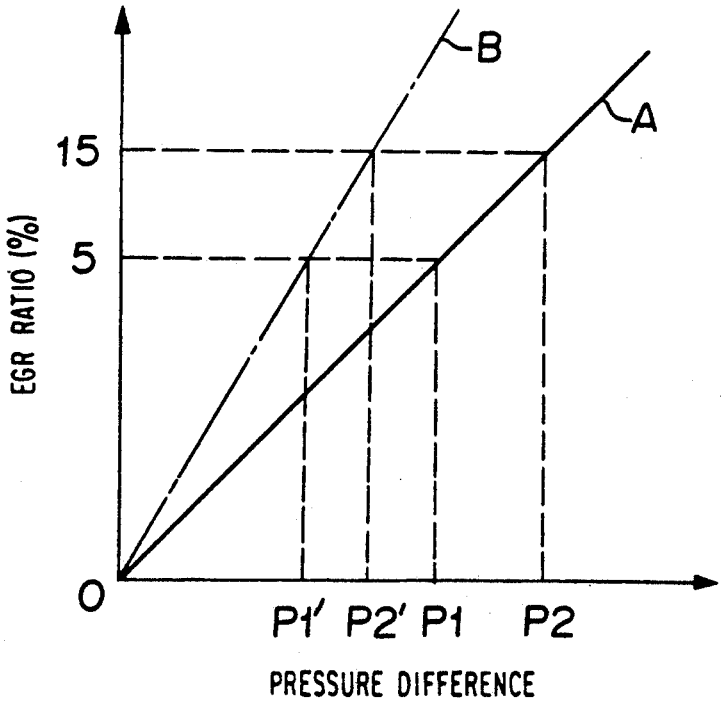
FIG. 4 is a graph showing a relationship between a pressure difference of the exhaust gas recirculation control device, and an EGR ratio.

FIG. 4 is a graph showing a relationship between the pressure difference at the intake manifold 4 and the EGR ratio (%). The bold line A and the one dot chain line B show load states of the internal combustion engine, respectively. When the EGR ratio is in the predetermined range of 5 to 15%, and when the load state of the engine is as shown in the bold line A, the difference portion (P2–P1) of the pressure difference of the intake manifold 4 for the EGR ratios of 15% and 5%, becomes large. On the contrary, when the load state of the engine is as shown by the one dot chain line B, the difference portion of the pressure difference of the intake manifold 4 (P2'–P1') becomes small. Therefore, the relationship between the pressure difference of the intake manifold 4 and the EGR ratio differs depending on the load state of the engine. In this invention, the pressure difference at the intake manifold 4 is detected. The detected value is corrected corresponding with the load state. When this corrected value is determined to be out of a predetermined range, this device is determined to be in failure.

Figure 5:
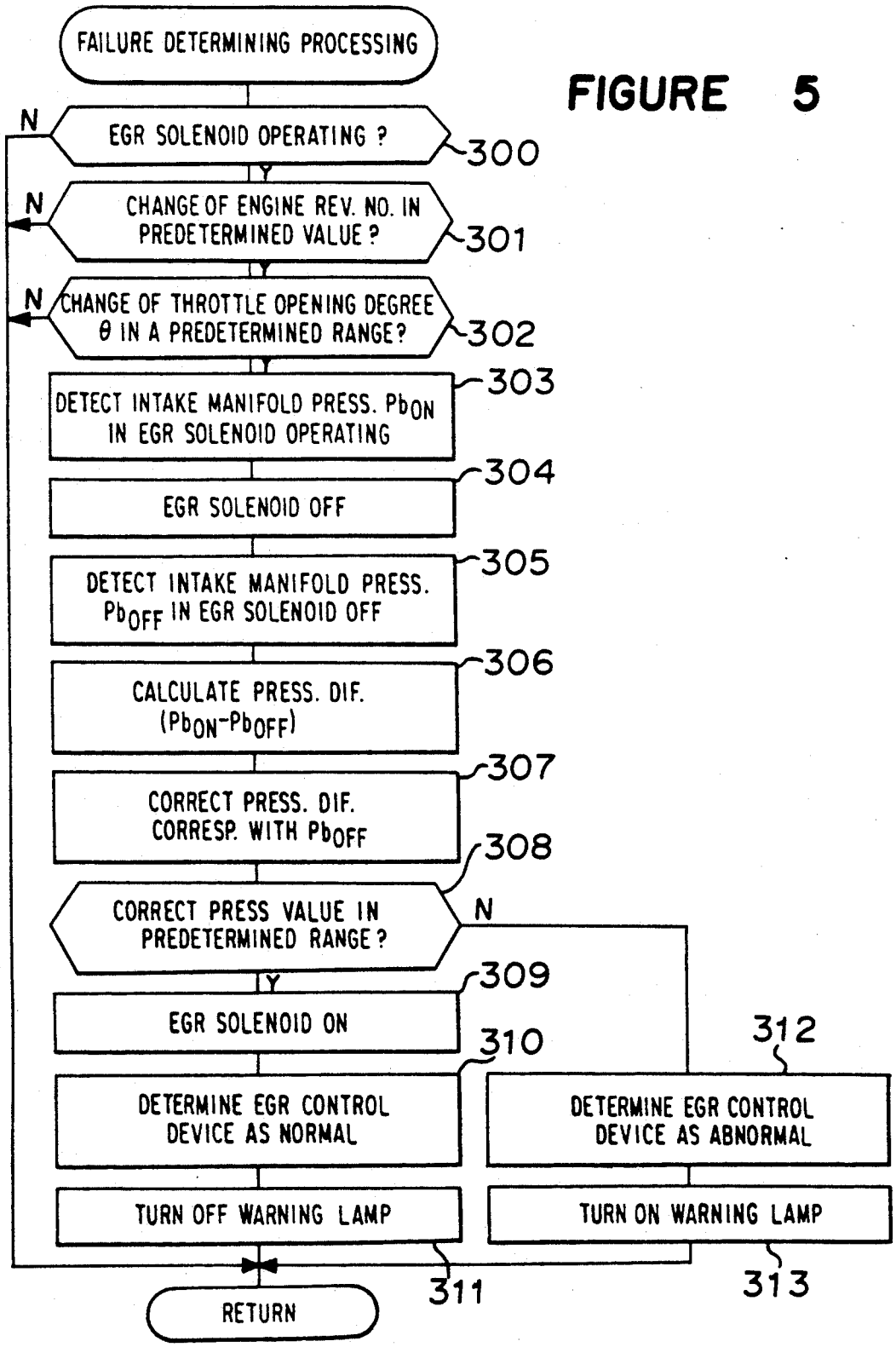
FIG. 5 is a flow chart describing an operation of the failure diagnosis device.

In the followings, a detailed operation of this failure diagnosis device will be explained based on the flow chart of FIG. 5.

First of all, the operation determines whether the EGR solenoid 12 is operated. When there is the EGR flow quantity, which is determined as Y, in step 301, the operation determines whether the change of the engine revolution number Ne is a predetermined value or less. When the change of the engine revolution number is the predetermined value or less, in step 302, the operation detects a signal from the throttle opening degree sensor 8, and determines whether the change of the throttle opening degree $\theta$ is a predetermined value or less. When the change of the throttle opening degree $\theta$ is the predetermined value or less, the engine is in steady state and the EGR solenoid 12 is operated. In step 303, the operation detects the pressure value of the intake manifold 4 in case that the EGR solenoid 12 is operating, $Pb_{ON}$ (first detected value) and memorizes it. In step 304, the operation makes the EGR solenoid 12 OFF, for obtaining the intake manifold pressure in case that the EGR flow quantity is "0". In step 305, the operation detects the intake manifold pressure $Pb_{OFF}$ in case that the EGR Solenoid 12 is OFF (second detected value) and memorizes it.

By this way, the actual intake manifold pressure $Pb_{ON}$ in case that the EGR flow quantity exists, and the intake manifold pressure $Pb_{OFF}$ in case that the EGR flow quantity does not exist, are obtained. In step 306, the operation calculates the pressure difference ($Pb_{ON}$-$Pb_{OFF}$) from the above values. In step 307, the operation determines a load state of the engine from the intake manifold pressure $Pb_{OFF}$ which is detected when the EGR flow quantity does not exist, to correct the calculated pressure difference according to the load state of the internal combustion engine, and corrects the above pressure difference ($Pb_{ON}$-$Pb_{OFF}$) corresponding with a value of this intake manifold pressure $pb_{OFF}$.

Furthermore, in step 308, the operation determines whether this corrected pressure difference, that is, the corrected pressure value is in a predetermined range. When the corrected pressure value is out of the predetermined range, in step 309, the operation makes the EGR solenoid 12 ON, and the operation flows the EGR, the quantity of which is as before. In step 310, the operation determines the EGR control device as normal, and sets a flag for normality, and turns off the alarming lamp 23 in step 311. Furthermore, when the corrected pressure value is out of the predetermined range, and when the operation determines as N in step 308, the operation determines the EGR control device as abnormal in step 312, and sets a flag for abnormality, and turns on the alarming lamp 23 in step 313.

In this embodiment, the running condition of the internal combustion engine, that is, the load state of the internal combustion engine is determined by the already detected intake manifold pressure $Pb_{OFF}$. Based on this load state of the engine, the pressure difference ($Pb_{ON}$-$Pb_{OFF}$) is corrected. However, the intake manifold pressure $Pb_{ON}$ in case that the EGR flow quantity exists, may be detected and the correction may be performed by determining the load state of the engine from this value. Furthermore, this correction may be performed based on a function value which shows a relationship between the engine revolution number and the throttle opening degree, or the measured value of the intake air quantity.

As apparent in the above explanation, in the first invention of the failure diagnosis device of the exhaust gas recirculation control device according to the present invention, the difference value between the first and the second detected values is obtained. The difference value is corrected based on one of the first and the second detected values. Furthermore, in the second invention, the difference value is corrected based on a function value which shows a relationship between the engine revolution number and the throttle opening degree, or the measured value of the intake air quantity. Therefore, this invention can precisely diagnose the failure state of the device due to the increase of the EGR flow quantity caused by the deterioration of parts of the BPT of the exhaust gas recirculation control device, or the decrease of the EGR flow quantity caused by the clogging of the valve, corresponding with the load state of the internal combustion engine.

What is claimed is:

1. A failure diagnosis device of an exhaust gas recirculation control device adapted to control to recirculate a part of exhaust gas of an internal combustion engine back to the internal combustion engine which comprises:

a recirculation pipe for recirculating the exhaust gas of the internal combustion engine to an intake air pipe;

a recirculation valve for controlling a flow quantity of the exhaust gas flowing in the recirculation pipe;

a recirculation valve passage area controlling means for controlling a passage area of the recirculation valve;

a running condition detecting means for detecting a running condition of the internal combustion engine;

a first detected value memorizing means for memorizing a first detected value which is detected by the running condition detecting means when the passage area of the recirculation valve is in a first state of being wide, by the recirculation valve passage area controlling means;

a second detected value memorizing means for memorizing a second detected value which is detected by the running condition detecting means when the passage area of the recirculation valve is in a second state of being zero, by the recirculation valve passage area controlling means;

a calculating and correcting means for calculating a difference value between the first detected value and the second detected value and for correcting the difference value based on one of the first and the second detected values;

a determining means for determining whether the corrected value is in a predetermined range; and an alarming means for alarming when the determining means determines that the corrected value is out of the predetermined range.

2. A failure diagnosis device of an exhaust gas recirculation control device adapted to control to recirculate a part of exhaust gas of an internal combustion engine back to the internal combustion engine which comprises:

a recirculation pipe for recirculating the exhaust gas of the internal combustion engine to an intake air pipe;

a recirculation valve for controlling a flow quantity of the exhaust gas flowing in the recirculating pipe;

a recirculation valve passage area controlling means for controlling a passage area of the recirculation valve;

a running condition detecting means for detecting a running condition of the internal combustion engine;

a first detected value memorizing means for memorizing a first detected value which is detected by the running condition detecting means when the passage area of the recirculation valve is in a first state of being wide, by the recirculation passage area controlling means;

a second detected value memorizing means for memorizing a second detected value which is detected by the running condition detecting means when the passage area of the recirculation valve is in a second state of being zero, by the recirculation valve passage area controlling means;

a calculating and controlling means for calculating a difference value between the first detected value and the second detected value and for correcting the difference value based on a measured value of a quantity of air sucked to the internal combustion engine or a value of a function of an engine revolution number and a throttle opening degree;

a determining means for determining whether the corrected value is in a predetermined range; and an alarming means for alarming when the determining means determines that the corrected value is out of the predetermined range.

* * * * *